US007219969B2

(12) United States Patent
Bezzubov

(10) Patent No.: US 7,219,969 B2
(45) Date of Patent: May 22, 2007

(54) STORAGE CONTAINER AND STORAGE SYSTEM INCLUDING A STACK OF THE SAME

(75) Inventor: Feodor Bezzubov, Tel Aviv (IL)

(73) Assignee: ZAG Industries Ltd., Rosh Ha'Ayin (IL)

( * ) Notice: Subject to any disclaimer, the term of this patent is extended or adjusted under 35 U.S.C. 154(b) by 368 days.

(21) Appl. No.: 10/736,648

(22) Filed: Dec. 17, 2003

(65) Prior Publication Data

US 2004/0169447 A1 Sep. 2, 2004

Related U.S. Application Data

(60) Provisional application No. 60/449,875, filed on Feb. 27, 2003.

(51) Int. Cl.
*A47B 87/00* (2006.01)

(52) U.S. Cl. ..... 312/107

(58) Field of Classification Search ..... 190/112, 190/114, 115, 4; 206/509, 511; 312/107, 312/111, 283, 257.1, 290, 240, 298, 330.1, 312/244; 220/507, 772, 771, 4.22, 812
See application file for complete search history.

(56) References Cited

U.S. PATENT DOCUMENTS

| | | | | |
|---|---|---|---|---|
| 2,541,890 | A | 2/1951 | Schaperkotter et al. | |
| 2,558,124 | A | 6/1951 | Burden | |
| 2,936,066 | A | 5/1960 | Meksula | |
| 2,990,083 | A * | 6/1961 | Strayer | 206/509 |
| 3,113,817 | A | 12/1963 | Imel | |
| 3,310,905 | A | 3/1967 | Davis et al. | |
| 4,129,346 | A | 12/1978 | Hoffman | |
| 4,285,556 | A * | 8/1981 | Loeffel | 312/244 |
| 4,420,079 | A * | 12/1983 | Gliniorz et al. | 206/408 |
| 4,561,705 | A | 12/1985 | Schafer | |
| 4,576,307 | A * | 3/1986 | Frydenberg | 220/324 |
| 4,615,461 | A * | 10/1986 | Liu | 220/815 |
| 4,619,363 | A * | 10/1986 | Wolfseder | 206/373 |
| 4,643,494 | A | 2/1987 | Marleau | |
| 4,768,651 | A * | 9/1988 | Lanius | 206/315.11 |
| 4,998,616 | A | 3/1991 | Hillinger | |
| 5,054,669 | A | 10/1991 | Zimbardi et al. | |
| 5,114,007 | A | 5/1992 | Chen | |
| 5,176,281 | A * | 1/1993 | Fiore | 220/520 |
| 5,203,469 | A * | 4/1993 | Chang et al. | 220/812 |
| 5,215,364 | A * | 6/1993 | Moore | 312/323 |
| 5,325,966 | A * | 7/1994 | Chang | 206/372 |
| 5,366,071 | A | 11/1994 | Laszlo | |
| 5,407,362 | A * | 4/1995 | Carstens et al. | 439/347 |
| 5,429,235 | A * | 7/1995 | Chen | 206/373 |
| 5,813,531 | A * | 9/1998 | Kao | 206/373 |
| 5,826,719 | A * | 10/1998 | Chen | 206/373 |
| 5,984,441 | A | 11/1999 | Stokhuijzen | |
| 6,062,385 | A | 5/2000 | Cho | |
| 6,196,405 | B1 * | 3/2001 | Kambouris | 220/4.22 |
| 6,367,642 | B2 * | 4/2002 | Kambouris et al. | 220/4.22 |
| 6,648,166 | B2 | 11/2003 | Levy | |
| 2004/0129595 | A1 * | 7/2004 | Dane et al. | 206/503 |
| 2005/0224384 | A1 * | 10/2005 | Sands et al. | 206/503 |

* cited by examiner

*Primary Examiner*—Peter M. Cuomo
*Assistant Examiner*—Noah Chandler Hawk
(74) *Attorney, Agent, or Firm*—Pillsbury Winthrop Shaw Pittman, LLP

(57) ABSTRACT

The present application relates to a storage container and a storage system include a stack of such storage container.

29 Claims, 13 Drawing Sheets

STORAGE CONTAINER AND STORAGE SYSTEM INCLUDING A STACK OF THE SAME

This application claims priority to U.S. Provisional application Ser. No. 60/449,875 filed Feb. 27, 2003. The entirety of the provisional application is incorporated herein by reference.

FIELD OF THE INVENTION

The present application relates to a storage container and a storage system including a stack of such storage containers.

SUMMARY OF THE INVENTION

One aspect of the present invention relates to a storage system comprising a plurality of stackable storage containers arranged in a vertical stack. The number of containers in the stack may be as few as two, and there is no upper limit. Each of the containers comprises (i) a drawer having a bottom wall and a peripheral wall defining a storage space for receiving articles, and an upwardly facing opening for accessing the storage space, and (ii) a drawer housing having at least an upper wall. The drawer is slidably mounted to the drawer housing for movement between (a) a retracted position wherein the drawer is positioned beneath the upper wall and (b) an extended position wherein the drawer is moved outwardly from beneath the upper wall, thereby allowing access to the storage space therein through the upwardly facing opening. The drawer housing is constructed to enable at least the upper wall of the drawer housing to be pivoted between (a) a closed position closing the upwardly facing opening of the drawer in its retracted position and (b) an open position uncovering the upwardly facing opening of the drawer in its retracted position. Each container also further comprises at least one upper coupling on an upper portion of the storage container, at least one lower coupling on a lower portion of the storage container, and a carrying handle for enabling the user to carry the storage container. The upper and lower couplings of each container are constructed such that, for each pair of vertically adjacent storage containers in the stack, (a) the upper coupling of a lower storage container of the pair is engaged in an interlocked relation with the lower coupling of an upper storage container of the pair to secure the storage containers of the pair together, and (b) the upper and lower couplings of the vertically adjacent storage containers of the pair can be disengaged to enable separation of the storage containers of the pair.

Another aspect of the invention relates to a storage container for stacking together with one or more similar storage containers. The storage container comprises a drawer having a bottom wall and a peripheral wall defining a storage space for receiving articles, and an upwardly facing opening for accessing the storage space. A drawer housing has at least an upper wall and the drawer is slidably mounted to the drawer housing for movement between (a) a retracted position wherein the drawer is positioned beneath the upper wall and (b) an extended position wherein the drawer is moved outwardly from beneath the upper wall, thereby allowing access to the storage space therein through the upwardly facing opening. The drawer housing is constructed to enable at least the upper wall of the drawer housing to be pivoted between (a) a closed position closing the upwardly facing opening of the drawer in its retracted position and (b) an open position uncovering the upwardly facing opening of the drawer in its retracted position.

The container also includes at least one upper coupling on an upper portion of the storage container and at least one lower coupling on a lower portion of the storage container. The upper coupling is constructed to be (a) engaged in an interlocked relation with a lower coupling of a similar storage container stacked atop the storage container to thereby secure the storage container and the similar storage container stacked atop thereof together, and (b) disengaged from the lower coupling of the similar storage container stacked atop the storage container, thereby allowing the storage container and the similar storage container stacked atop the storage container to be separated. The lower coupling is constructed to be (a) engaged in an interlocked relation with an upper coupling of a similar storage container stacked below the storage container to thereby secure the storage container and the similar storage container stacked below the storage container together, and (b) disengaged from the upper coupling of the similar storage container stacked below the storage container, thereby allowing the storage container and the similar storage container to be separated. The container also further comprises a carrying handle for enabling a user to carry the storage container.

Other objects, features, and advantages of the present invention will become apparent from the following detailed description, the accompanying drawings, and the appended claims.

DETAILED DESCRIPTION OF THE ILLUSTRATED EMBODIMENT

Figure 1:
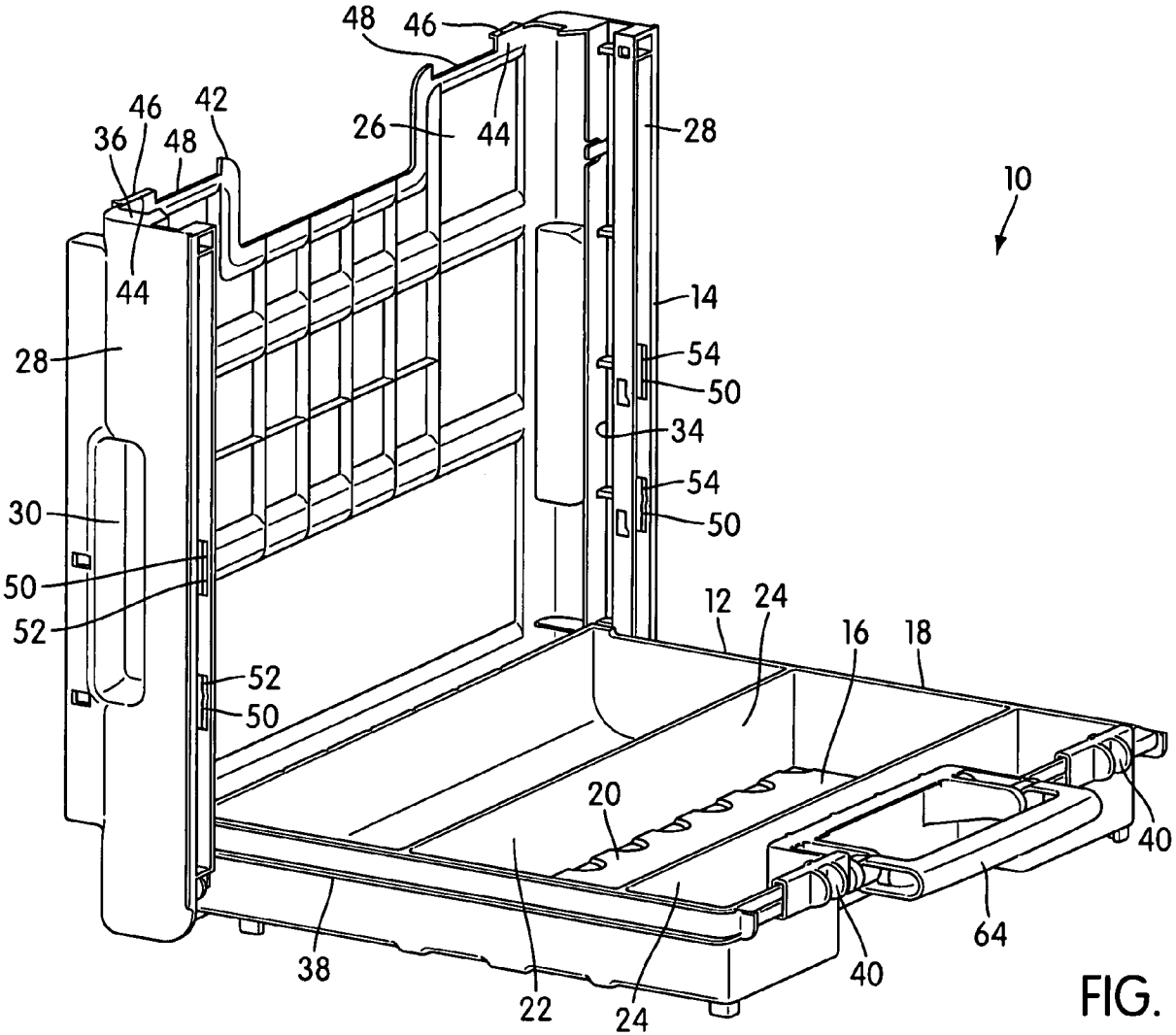
FIG. 1 is a perspective view of a storage container according to the invention with the drawer housing open.
Figure 1A:
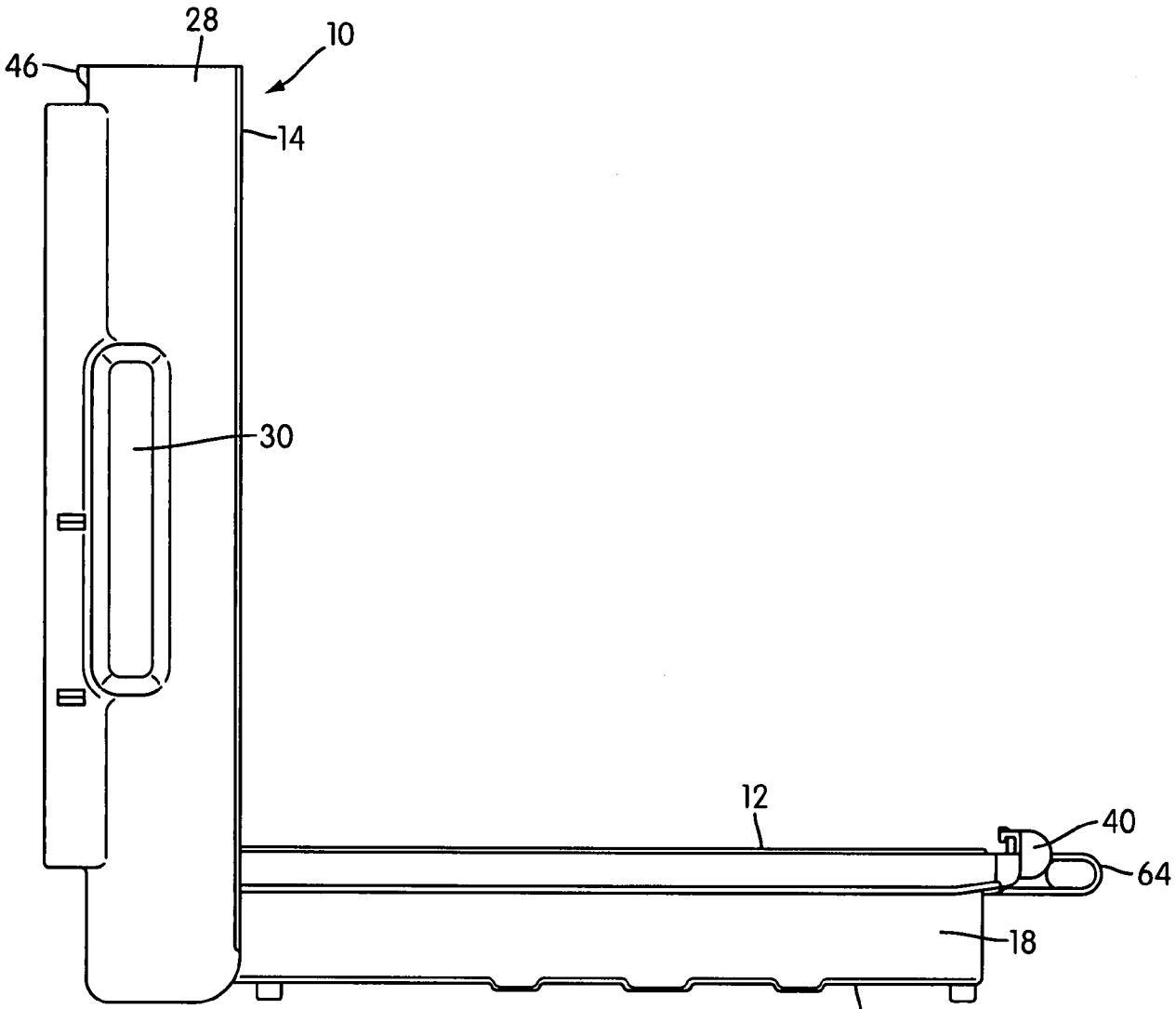
FIG. 1A is a side view of the storage container of FIG. 1.

FIG. 1 shows a storage container, generally indicated at 10, constructed in accordance with the present invention. In general, the storage container 10 comprises a drawer 12 and a drawer housing 14. The drawer 12 is formed from plastic by injection molding. The drawer 12 has a bottom wall 16 and a peripheral wall 18 defining a storage space 20 for receiving articles and an upwardly facing opening 22 for accessing the storage space 20. In the illustrated embodiment, the drawer 12 has internal vertical partitions 24 separating the drawer into a series of smaller compartments. However, the drawer 12 may have any suitable construction or configuration and the invention is not limited to the one illustrated.

Figure 2:
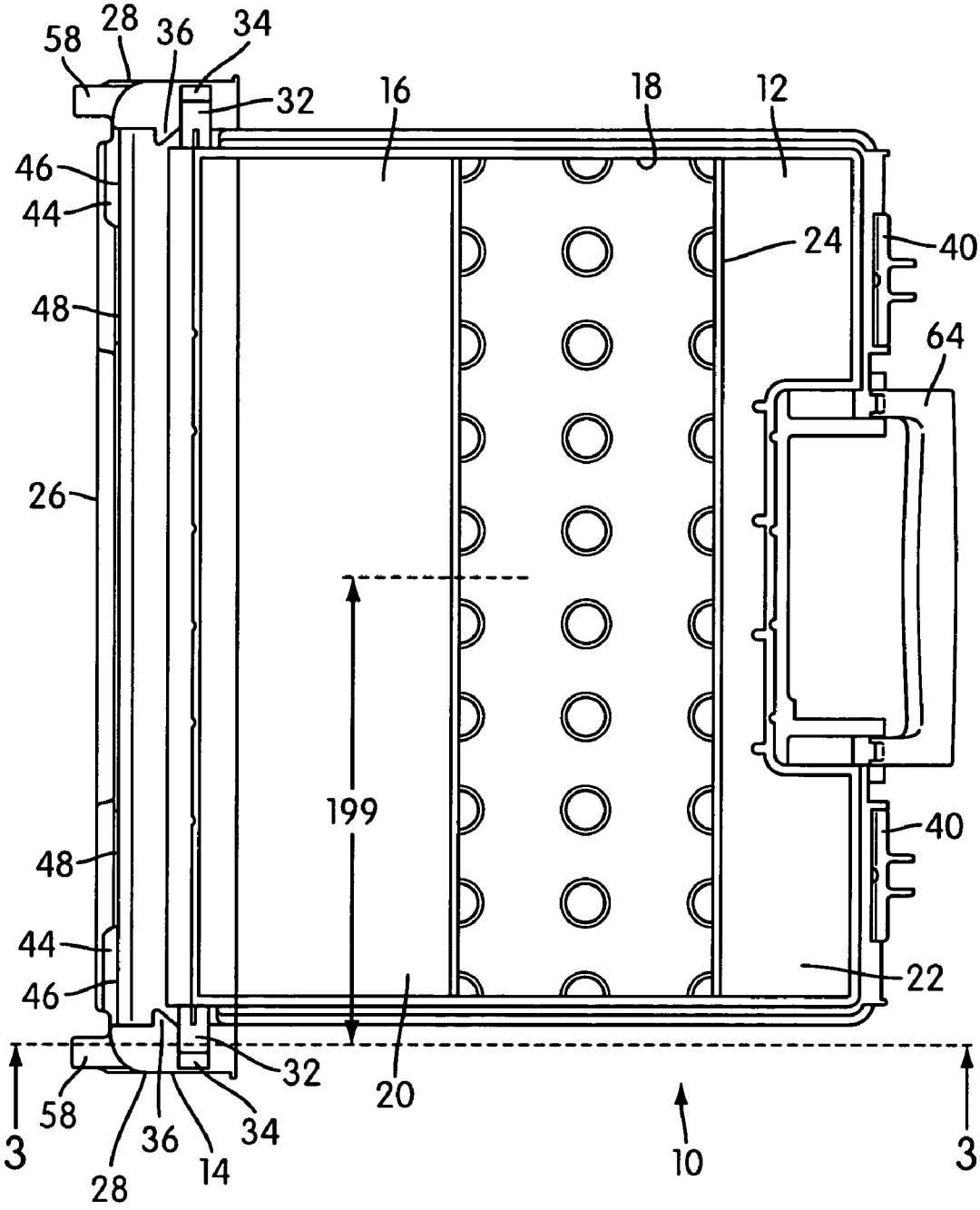
FIG. 2 is a top view of the storage container of FIG. 1
Figure 4:
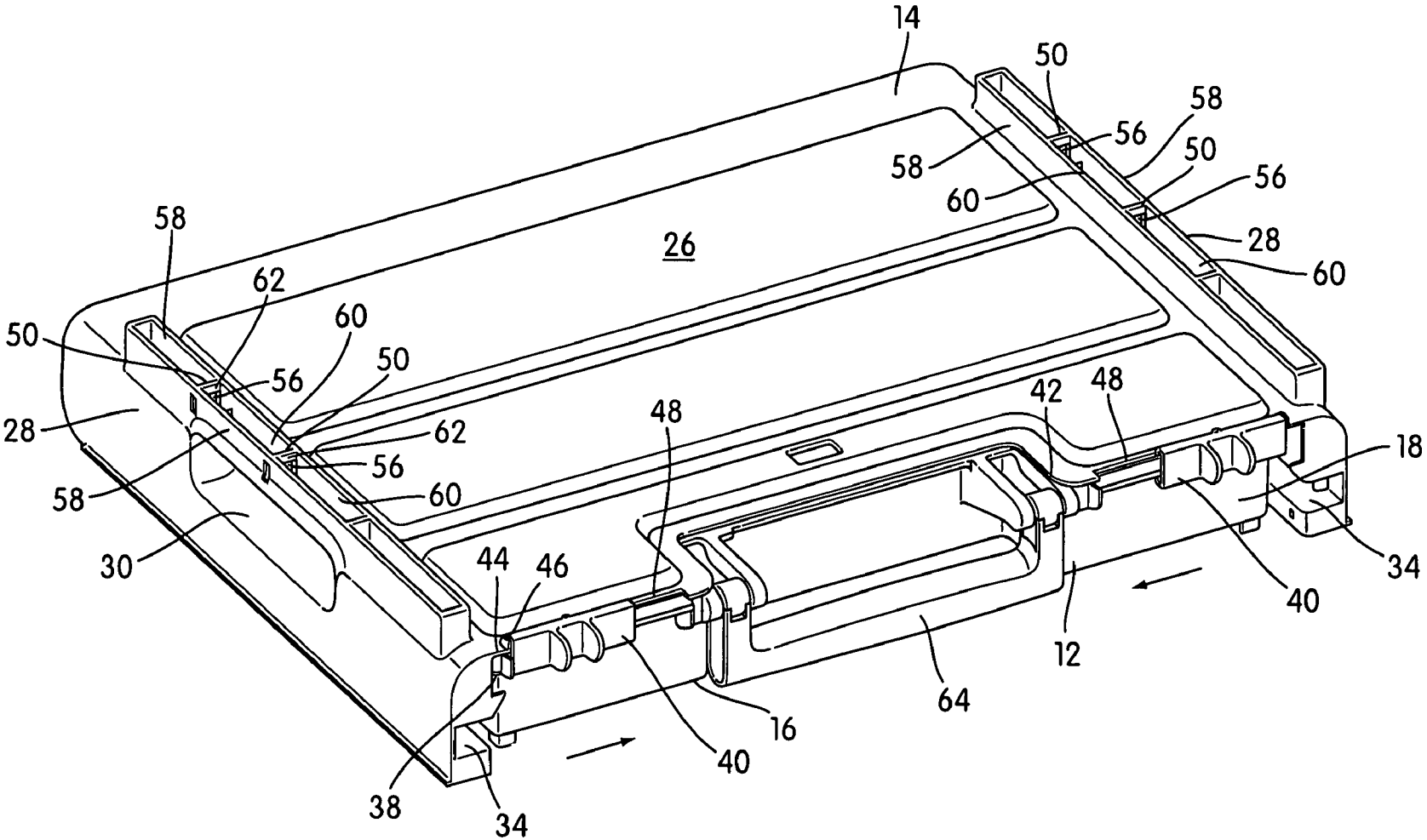
FIG. 4 is a perspective view of the storage container of FIG. 1, but with the drawer housing closed.
Figure 5:
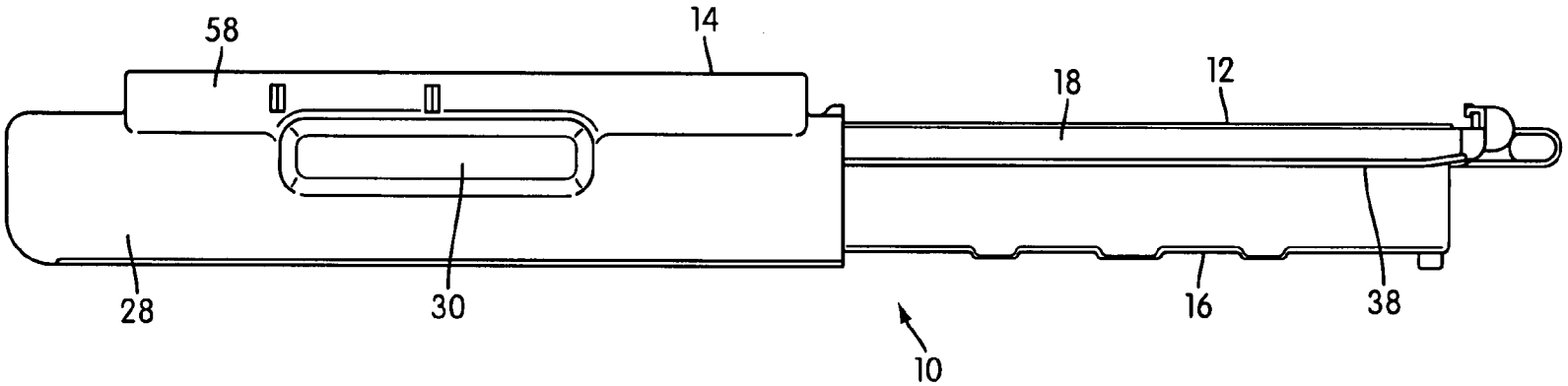
FIG. 5 is a side view of the storage container with the drawer in the extended position.
Figure 6:
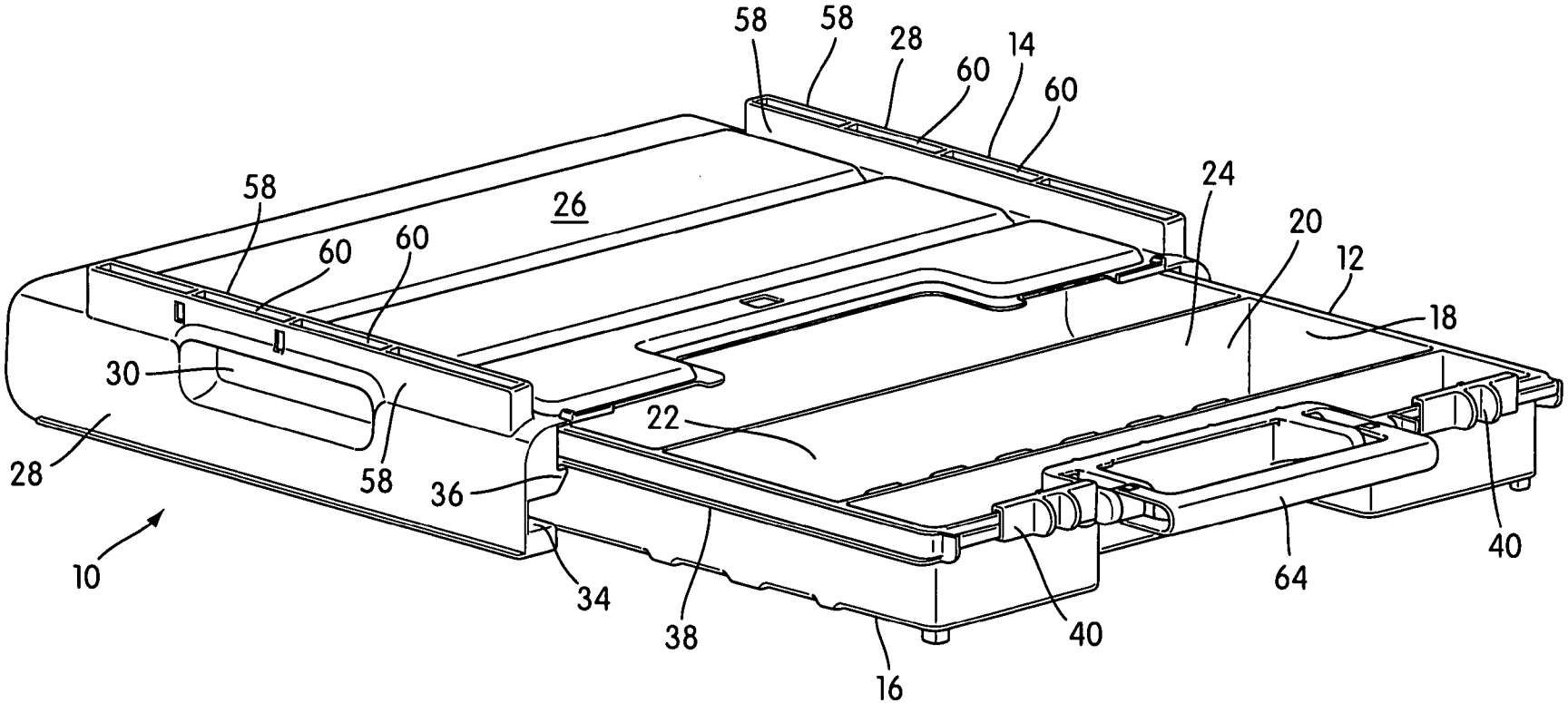
FIG. 6 is a perspective view of the subject matter of FIG. 5.
Figure 7:
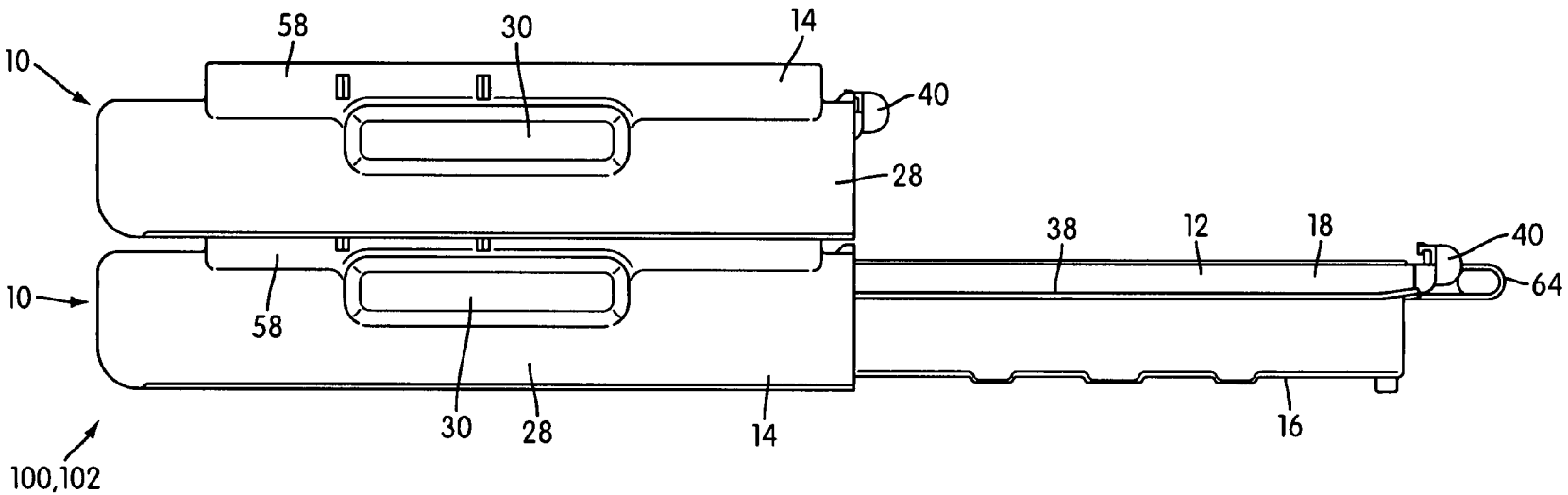
FIG. 7 is a side view of a stack of storage containers.
Figure 8:
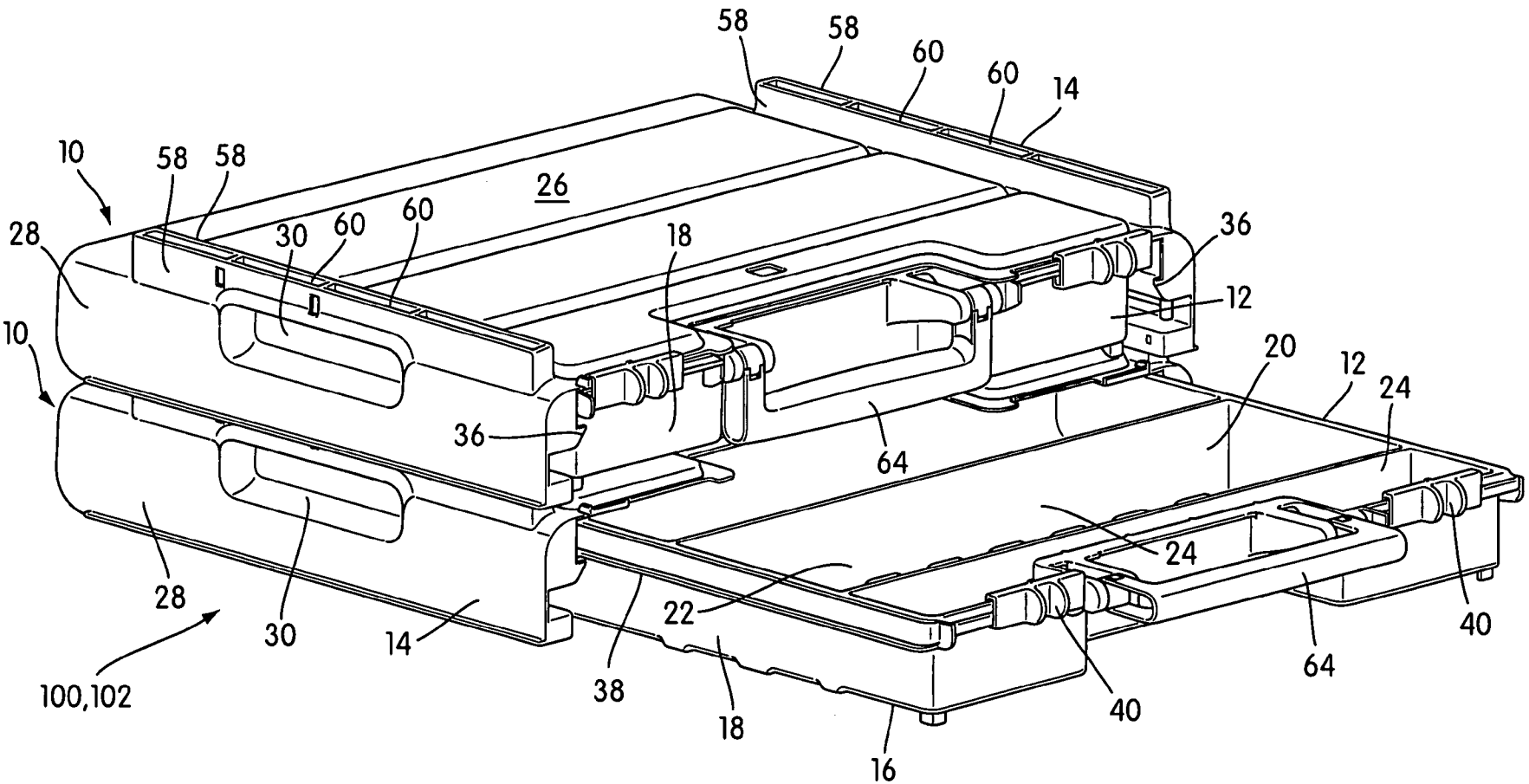
FIG. 8 is a perspective view of the subject matter of FIG. 7.
Figure 9:
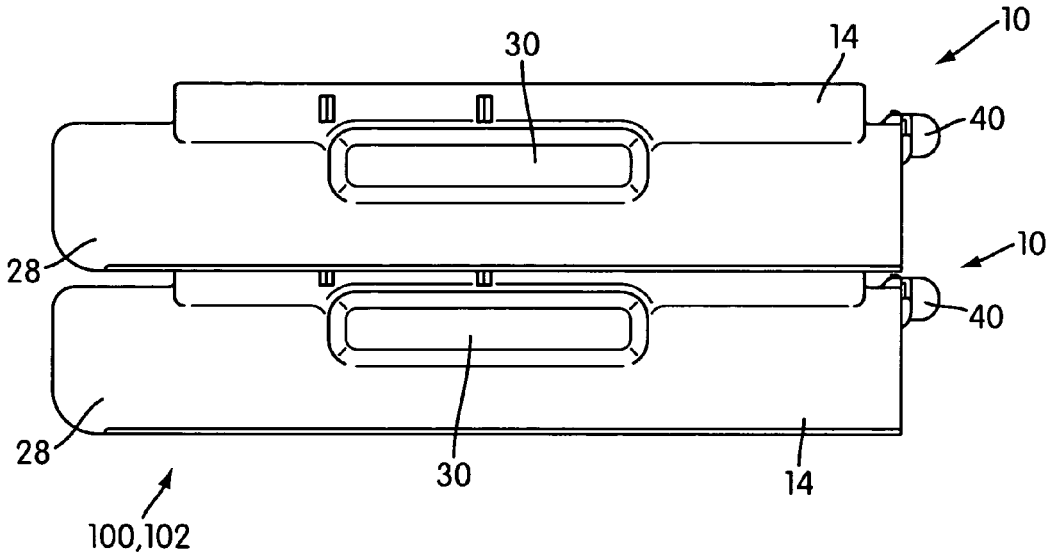
FIG. 9 is a side view of a stack of storage containers.
Figure 10:
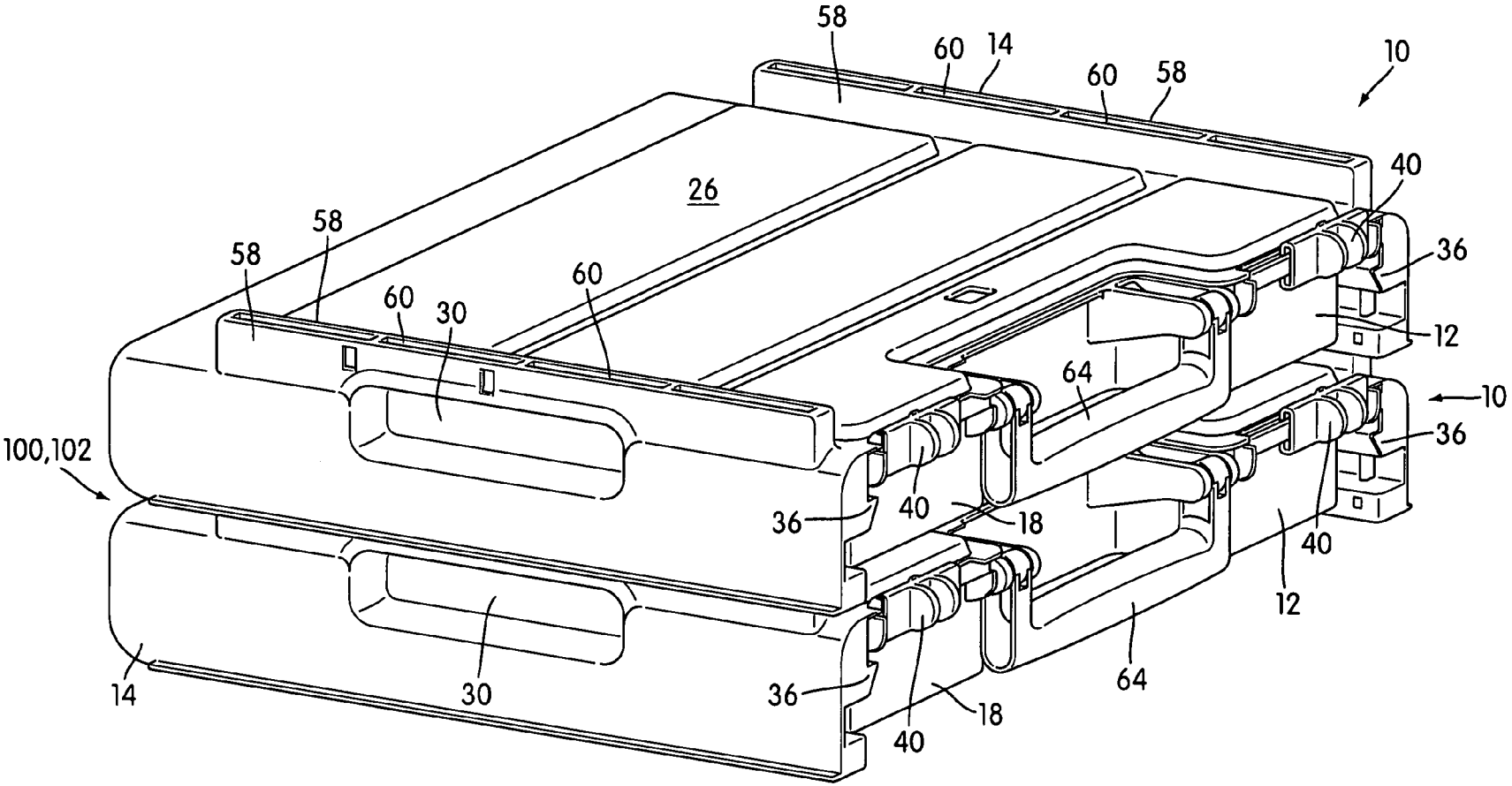
FIG. 10 is a perspective view of the subject matter of FIG. 9.
Figure 11:
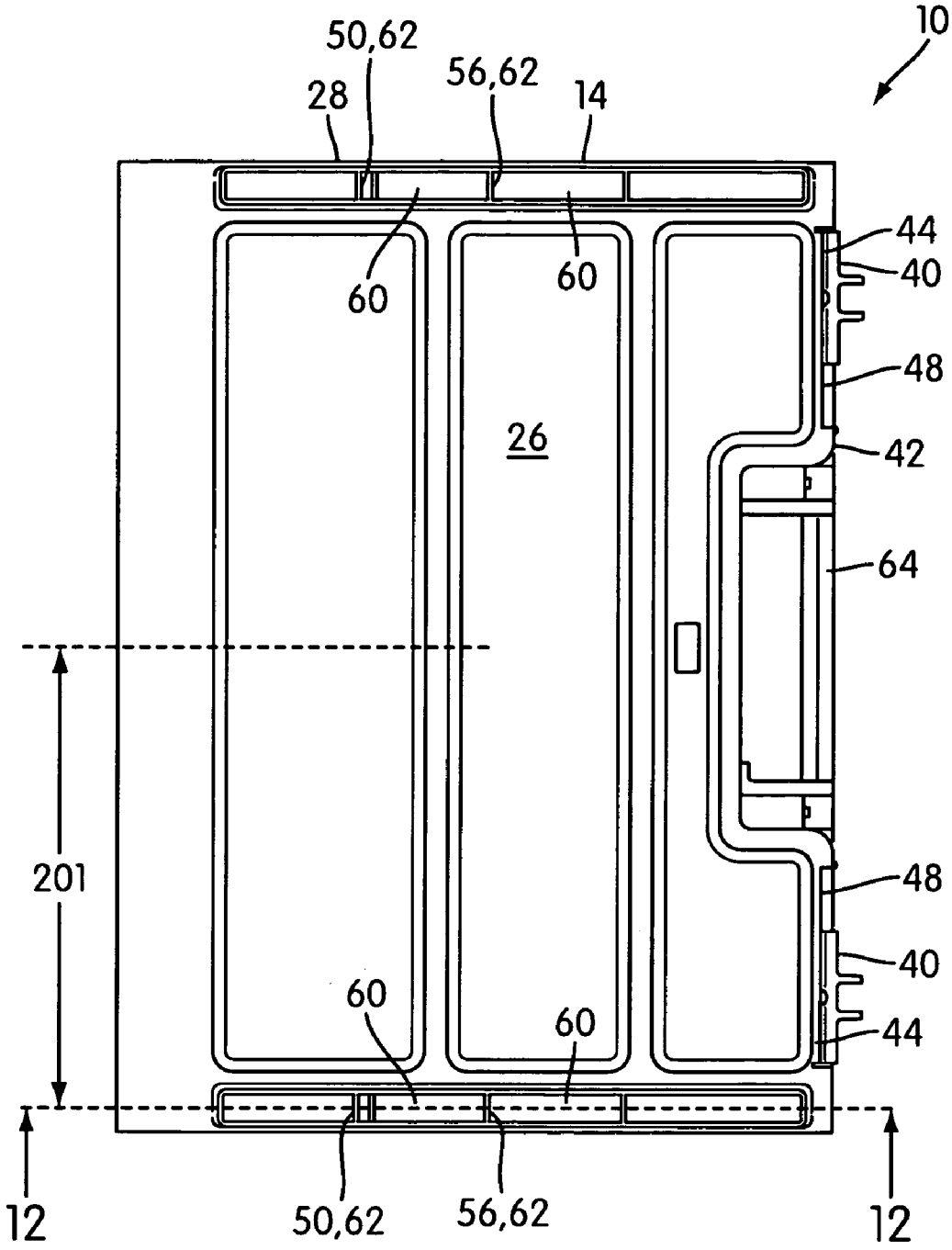
FIG. 11 is a top view of a stack of storage containers.

The drawer housing 14 in the illustrated embodiment is formed from plastic by injection molding and has at least an upper wall 26. The drawer 12 is slidably mounted to the drawer housing 14 for movement between (a) a retracted position wherein the drawer 12 is positioned beneath the upper wall 26 and (b) an extended position wherein the drawer 12 is moved outwardly from beneath the upper wall 26, thereby allowing access to the storage space 20 therein through the upwardly facing opening 22. The retracted position is shown, for example, in FIG. 4, and the extended position is shown, for example, in FIGS. 5 and 6. The drawer housing 14 is also constructed to enable at least the upper wall 26 of the drawer housing 14 to be pivoted between (a) a closed position closing the upwardly facing opening 22 of the drawer 12 in its retracted position and (b) an open position uncovering the upwardly facing opening 22 of the drawer in its retracted position. The open position is shown, for example, in FIGS. 1–3, and the closed position is shown for example, in FIGS. 4–6.

In the illustrated embodiment, the drawer housing 14 has a pair of side walls 28 extending downwardly from the upper wall 26 on opposing sides of the drawer 12. Further, in the illustrated embodiment the upper wall 26 and the side walls 28 of the drawer housing 14 are fixed together, preferably by being molded together as a single piece, so that the side walls 28 are pivoted along with the upper wall 26 between the open and closed positions thereof. A recess 30 is provided on each side wall 28 to act as handles for facilitating carrying the container 10 in two hands, or for raising the housing 14 to establish the open position of the upper wall 26. As an alternative, the upper wall could be pivotally mounted to the side walls 28. Also, the presence of the side walls 28 is not necessary, and instead is only preferred. Thus, the drawer housing 14 may have any suitable construction or configuration and the invention is not limited to the one illustrated.

Figure 3:
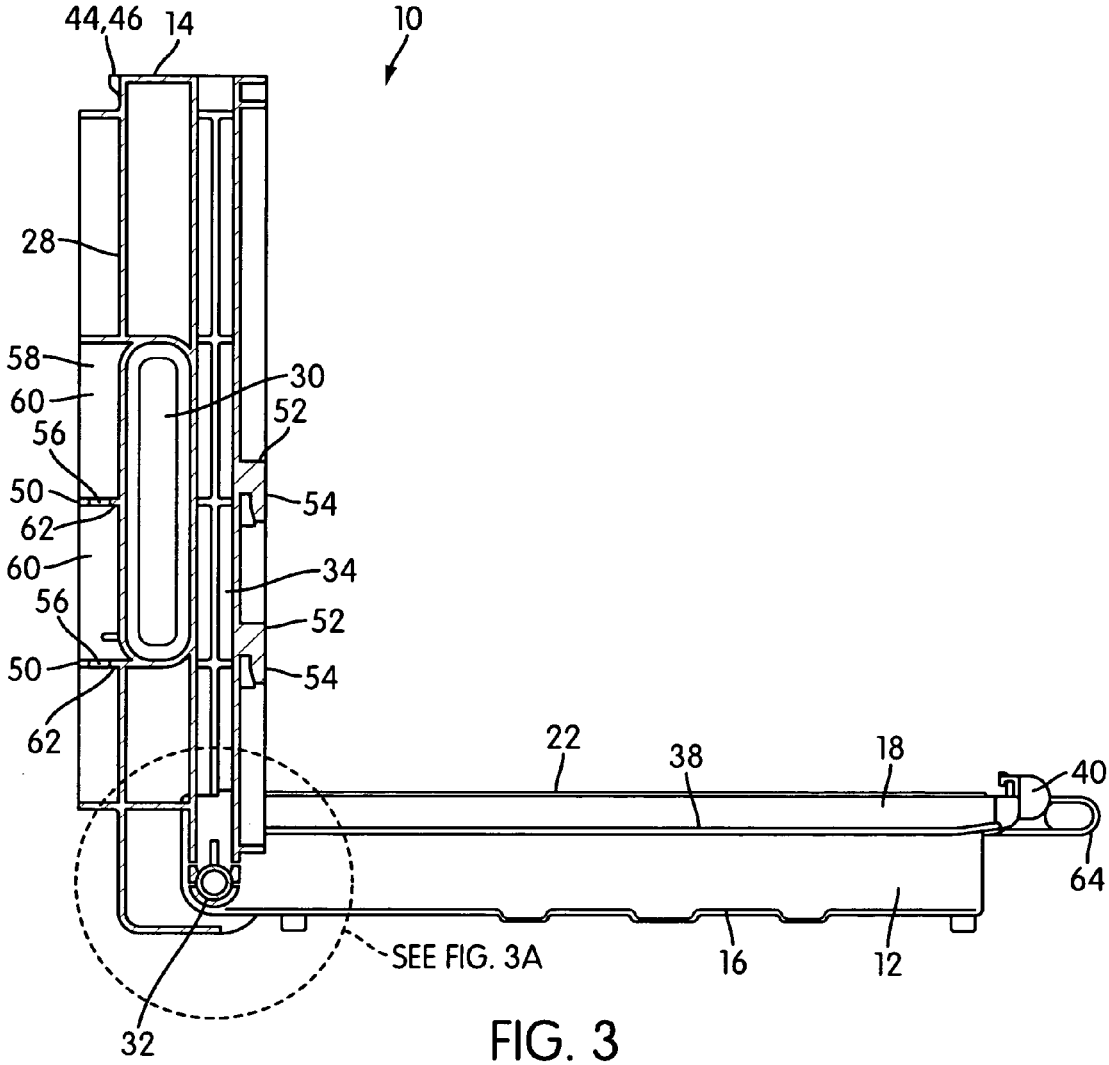
FIG. 3 is a cross-section taken along line A—A in FIG. 2.
Figure 3A:
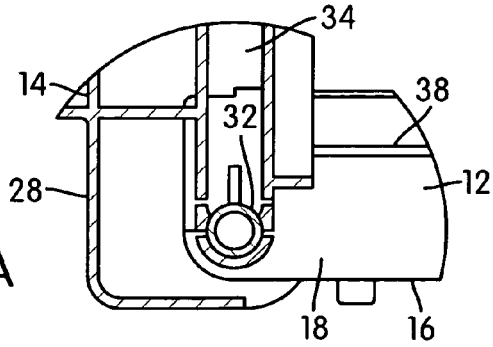
FIG. 3A is a close-up view showing details of FIG. 3.

As seen for example in FIGS. 3 and 3A, in the illustrated embodiment, the drawer 12 includes a pair of pivot pins 32 extending from opposing sides thereof and the side walls 28 of the drawer housing 14 include a pair of inwardly facing tracks 34. The pins 32 may be formed integrally with the drawer 12 by injection molding, or may be attached as separate pieces. The pivot pins 32 are slidably and pivotably received in the tracks 34 to enable (a) the upper wall 26, along with the remainder of the drawer housing 14, to be pivoted about the pivot pins 32 between the open and closed positions, and (b) the drawer 12 to be moved between the retracted and extended positions with the pivot pins 32 riding rectilinearly within the tracks 34. The presence of the pins and tracks is not necessary, and instead is only preferred. Thus, the drawer 12 and drawer housing 14 may have any suitable construction or configuration and the invention is not limited to those illustrated.

Each side wall 28 of the drawer housing 14 also includes a support flange 36 extending inwardly adjacent a front end of the drawer housing 14. These flanges 36 are provided by plate-like walls that extend inwardly from the front end of the drawer housing 14. The drawer 12 also has a pair of support ridges 38 extending longitudinally on each side thereof. The support ridges 38 are supported by the support flanges 36 to support the drawer 12 as it moves between the retracted and extended positions thereof Because the flanges 36 are made of plastic material and have a plate-like wall construction, the support flanges 36 are resiliently deflectable for clearing the support ridges 38 as the drawer housing 14 is pivoted to establish the open position of the upper wall 26. Specifically, the flanges 36 engage the ridges 38 and inhibit pivoting of the drawer housing 14 even when the latches 40 (discussed below) are in their released position, but will be deflected by forcing the drawer housing 14 upward. Conversely, upon moving the drawer housing 14 back down to the closed position of the upper wall 26, the angled lower surfaces of the flanges 36 will engage the ridges 38 and the flanges 36 will deflect inwardly and resiliently return to their supporting relation beneath the ridges 38. The presence of the flanges 36 and ridges 38 is not necessary, and instead is only preferred. Thus, the drawer 12 and drawer housing 14 may have any suitable construction or configuration and the invention is not limited to those illustrated.

The container 10 further comprises a pair of latches 40. The latches 40 are movable between (a) a latching position releasably latching the drawer 12 in the retracted position thereof, and (b) a released position enabling the drawer 12 to be moved to the extended position thereof. Further, the latches 40 in the latching position thereof also releasably latch the upper wall 26 in its closed position, and in the released position thereof enables the upper wall 26 to be moved to its open position. In the illustrated embodiment, the latches 40 are slidably mounted on a front face of the drawer 12 for lateral movement between the latched and released positions thereof. Further, in the illustrated embodiment, the structure which the latches 40 engage is the upper wall 26 on the drawer housing 14. The upper wall 26 has a front edge 42 with (a) latch engaging portions 44 each having a lip 46 protruding upwardly therefrom and (b) recesses 48 adjacent the latch engaging portions 44. The recesses 48 are positioned such that, when the drawer 12 is in the retracted position thereof and the upper wall 26 is in the closed position thereof, the latches 40 in their released positions are received in the recesses 48, and then can be moved laterally outwardly onto the latch engaging portions 44 and the lips 46 thereof to affect the latched positions thereof. Any suitable construction or configuration may be used for securing the drawer 12 in its retracted position, and/or the upper wall 26 in its closed position, and the invention is not intended to be limited to the illustrated embodiment.

The container 10 also includes at least one upper coupling 50 on an upper portion of the storage container 10 and at least one lower coupling 52 on a lower portion of the storage container 10. As can be appreciated best from FIGS. 12 and 13, the upper coupling 50 is constructed to be (a) engaged in an interlocked relation with a lower coupling 52 of a similar storage container stacked atop the storage container 10 to thereby secure the storage container 10 and the similar storage container stacked atop thereof together, and (b) disengaged from the lower coupling 52 of the similar storage container stacked atop the storage container 10, thereby allowing the storage container and the similar storage container stacked atop the storage container to be separated. Likewise, the lower coupling 52 is constructed to be (a) engaged in an interlocked relation with an upper coupling 50 of a similar storage container stacked below the storage container 10 to thereby secure the storage container 10 and the similar storage container stacked below the storage container 10 together, and (b) disengaged from the upper coupling 50 of the similar storage container stacked below the storage container 10, thereby allowing the storage container 10 and the similar storage container to be separated.

In this context, a similar storage container is meant to be a storage container identical to storage container 10, or having a similar construction with suitable upper and lower couplings 50 and 52 for enabling the stacking and interlocking.

In the illustrated embodiment, the at least one lower coupling includes 52 a plurality of hooks 54 on lower portions of the storage container 10 and the at least one upper coupling 50 includes a plurality of receptacles 56 on upper portions of the storage container 10. The receptacles 56 are constructed to be (a) engaged in an interlocked relation with hooks 54 of a similar storage container stacked atop the storage container 10 to thereby secure the storage container 10 and the similar storage container stacked atop thereof together, and (b) disengaged from the hooks 54 of the similar storage container stacked atop the storage container 10, thereby allowing the storage container 10 and the similar storage container stacked atop the storage container 10 to be separated. Likewise, the hooks 54 are constructed to be (a) engaged in an interlocked relation with receptacle 56 of a similar storage container stacked below the storage container 10 to thereby secure the storage container 10 and the similar storage container stacked below the storage container 10 together, and (b) disengaged from the receptacles 56 of the similar storage container stacked below the storage container 10, thereby allowing the storage container 10 and the similar storage container to be separated.

Figure 12:
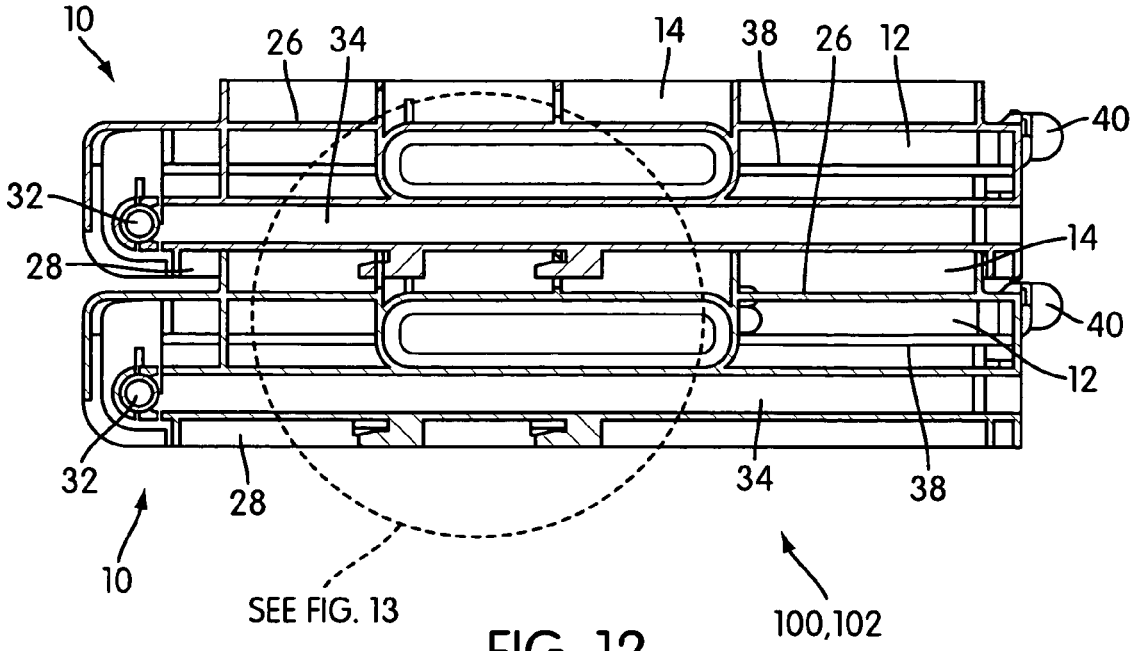
FIG. 12 is a cross-section taken along line A—A of FIG. 11.
Figure 13:
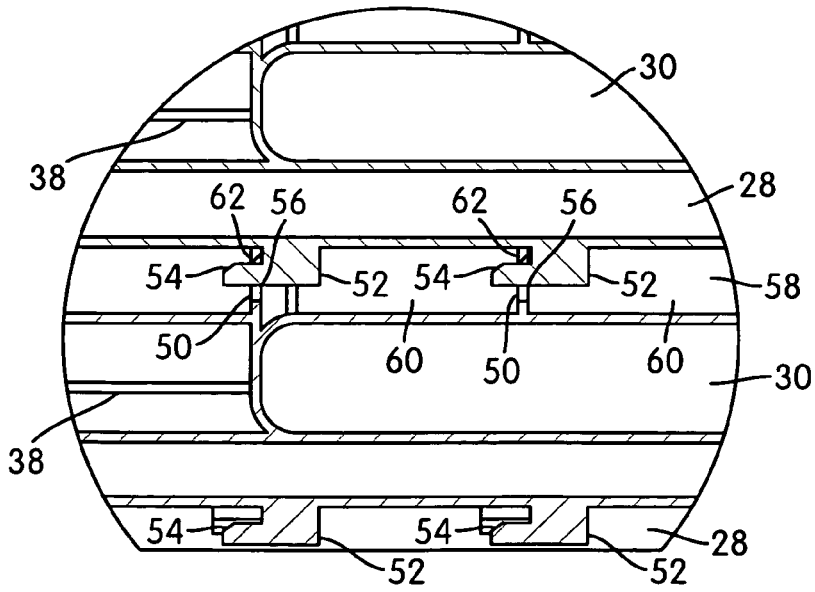
FIG. 13 is a close-up view showing details of FIG. 12.

As can be appreciated from FIGS. 12 and 13, disengaging the hooks 54 from the receptacles 56 is affected by shifting the upper container of a stacked pair forward, and the upper container can be lifted off the lower one. To secure the upper container in place, the upper container is stacked atop the lower container so that the hooks 54 are aligned with the receptacles 56, and then the upper container is shifted rearwardly to engage the hooks 54 in the receptacles.

Further, integrally formed plastic in the illustrated embodiment, the upper portions of the side walls 28 each include upstanding walls 58 defining recessed wells 60 and the receptacles 56 are formed through walls 62 located within the recessed wells 60. The hooks 54 are integrally formed plastic and extend downwardly from lower portions of the side walls 28. Any suitable construction or configuration may be used for securing storage containers 10 in a stack, and the invention is not intended to be limited to the illustrated embodiment.

The container 10 also further comprises a carrying handle 64 for enabling a user to carry the storage container 10. Preferably, the carrying handle 64 is pivotably connected to a front wall of the drawer 12 for facilitating movement of the drawer 12 between the retracted and extended positions thereof.

With this general construction, a plurality of storage containers 10, which may be any number of two or more containers 10, may be vertically arranged in a stack 100 to define a storage system 102 as shown in FIGS. 7–13. Each container 10 may be individually removed from the stack 100 for transportation by its carrying handle 64 separate from the stack 100. The stack 100 is held together by the upper and lower couplings 50, 52 so that, for each pair of vertically adjacent storage containers 10 in the stack 100, (a) the upper coupling 50 of a lower storage container 10 of the pair is engaged in an interlocked relation with the lower coupling 52 of an upper storage container 10 of the pair to secure the storage containers 10, 10 of the pair together, and (b) the upper and lower couplings 50, 52 of the vertically adjacent storage containers 10, 10 of the pair can be disengaged to enable separation of the storage containers 10, 10 of the pair. The user thus may opt to take the container 10 from the top, or remove one or more containers 10 to enable one in the middle or on the bottom of the stack 100 to be removed. The user may also opt to access any given container 10 by moving its drawer 12 to the extended position thereof.

The invention is particularly advantageous for use in modular storage whereby a user can store a number of articles in the containers 10 and have the advantages of a system 102 that stores a wide variety of articles, but enables each container 10 to be separated for transporting only selected articles in any given container 10. For example, a user could store a number of different tools and tool accessories in the storage containers 10, and when the user needs to access the tools, he can either (a) leave the containers 10 in the stack 100 and access the containers 10 by the drawers 12, or (b) separate a desired container 10 with the particular tools he/she needs and transport that container 10 to a work location. The tool context is not limiting, and the invention could be applied to contexts such as children's toys, arts and crafts, sewing and other domestic activities, or fishing and other recreational activities, etc.

The foregoing illustrated embodiment has been provided solely for illustrating the structural and functional principles of the present invention and is not intended to be limiting. To the contrary, the present invention is intended to encompass all modifications, substitutions, alterations, and equivalents encompassed within the spirit and scope of the following claims.

What is claimed:

1. A storage system comprising:

a plurality of stackable storage containers arranged in a vertical stack, each of the containers comprising:

(i) a drawer having a bottom wall and a peripheral wall defining a storage space for receiving articles and an upwardly facing opening for accessing the storage space, (ii) a drawer housing having at least an upper wall, the drawer being slidably mounted to the drawer housing for movement between (a) a retracted position wherein the drawer is positioned beneath the upper wall and (b) an extended position wherein the drawer is moved outwardly from beneath the upper wall, thereby allowing access to the storage space therein through the upwardly facing opening, the drawer housing being constructed to enable at least the upper wall of the drawer housing to be pivoted between (a) a closed position closing the upwardly facing opening of the drawer in its retracted position and (b) an open position uncovering the upwardly facing opening of the drawer in its retracted position, (iii) at least one upper coupling on an upper portion of the storage container and at least one lower coupling on a lower portion of the storage container, (iv) a carrying handle for enabling the user to carry the storage container, and (v) a latch movable between (a) a latching position releasably latching the drawer in the retracted position thereof, and (b) a released position enabling the drawer to be moved to the extended position thereof;

the upper and lower couplings of each container being constructed such that, for each pair of vertically adjacent storage containers in the stack, (a) the upper coupling of a lower storage container of the pair is engaged in an interlocked relation with the lower coupling of an upper storage container of the pair to secure the storage containers of the pair together, and (b) the upper and lower couplings of the vertically adjacent storage containers of the pair can be disengaged to enable separation of the storage containers of the pair.

2. A storage system according to claim 1, wherein the plurality of storage containers includes three or more storage containers.

3. A storage system according to claim 1, wherein the latch on each storage container in the latching position thereof also releasably latches the upper wall in the closed position thereof and in the released position thereof enables the upper wall to be moved to the open position thereof.

4. A storage system according to claim 3, wherein the latch on each storage container is slidably mounted on a front face of the drawer for lateral movement between the latched and released positions thereof.

5. A storage system according to claim 4, wherein the upper wall on the drawer housing of each storage container has a front edge with (a) a latch engaging portion having a lip protruding upwardly therefrom and (b) a recess adjacent the latch engaging portion, the recess being positioned such that, when the drawer is in the retracted position thereof and the upper wall is in the closed position thereof, the latch in its released position is received in the recess, and then can be moved laterally onto the latch engaging portion and the lip thereof to affect the latched position thereof.

6. A storage system according to claim 3, wherein in each storage container the carrying handle is connected to a front wall of the drawer for facilitating movement of the drawer between the retracted and extended positions thereof.

7. A storage system according to claim 1, wherein the drawer housing of each storage container has a pair of side walls extending downwardly from the upper wall on opposing sides of the drawer.

8. A storage system according to claim 7, wherein the upper wall and the side walls of the drawer housing of each storage container are fixed together so that the side walls are pivoted along with the upper wall between the open and closed positions thereof.

9. A storage system according to claim 8, wherein in each storage container the drawer includes a pair of pivot pins extending from opposing sides thereof and the side walls of the drawer housing include a pair of inwardly facing tracks, the pivot pins being slidably and pivotably received in the tracks to enable (a) the upper wall and the side walls to be pivoted about the pivot pins between the open and closed positions of the upper wall, and (b) the drawer to be moved between the retracted and extended positions with the pivot pins riding within the tracks.

10. A storage system according to claim 9, wherein in each storage container each side wall of the drawer housing includes a support flange extending inwardly adjacent a front end of the drawer housing and wherein the drawer has a pair of support ridges extending on each side thereof, the support ridges being supported by the support flanges to support the drawer as it moves between the retracted and extended positions thereof.

11. A storage system according to claim 10, wherein in each storage container the support flanges are deflectable for clearing the support ridges as the upper wall and side walls are pivoted to the open position.

12. A storage system according to claim 7, wherein in each storage container the at least one lower coupling includes a hook and the at least one upper coupling includes a receptacle, and wherein the hooks and receptacles are constructed such that, for each pair of vertically adjacent storage containers in the stack, (a) the hook of an upper storage container of the pair is engaged in an interlocked relation with the receptacle of the lower storage container of the pair to secure the storage containers of the pair together, and (b) the hook and receptacle of the vertically adjacent storage containers of the pair can be disengaged to enable separation of the storage containers of the pair.

13. A storage system according to claim 12, wherein in each storage container the hook includes a plurality of hooks provided on lower portions of the side walls and the receptacle includes a corresponding plurality of receptacles provided on upper portion of the side walls.

14. A storage system according to claim 13, wherein in each storage container the upper portions of the side walls each include recessed wells and wherein the receptacles are located within the recessed wells.

15. A storage system according to claim 1, wherein in each storage container the at least one lower coupling includes a hook and the at least one upper coupling includes a receptacle, and wherein the hooks and receptacles are constructed such that, for each pair of vertically adjacent storage containers in the stack, (a) the hook of an upper storage container of the pair is engaged in an interlocked relation with the receptacle of the lower storage container of the pair to secure the storage containers of the pair together, and (b) the hook and receptacle of the vertically adjacent storage containers of the pair can be disengaged to enable separation of the storage containers of the pair.

16. A storage container for stacking together with one or more similar storage containers, the storage container comprising:

a drawer having a bottom wall and a peripheral wall defining a storage space for receiving articles and an upwardly facing opening for accessing the storage space, a drawer housing having at least an upper wall, the drawer being slidably mounted to the drawer housing for movement between (a) a retracted position wherein the drawer is positioned beneath the upper wall and (b) an extended position wherein the drawer is moved outwardly from beneath the upper wall, thereby allowing access to the storage space therein through the upwardly facing opening, the drawer housing being constructed to enable at least the upper wall of the drawer housing to be pivoted between (a) a closed position closing the upwardly facing opening of the drawer in its retracted position and (b) an open position uncovering the upwardly facing opening of the drawer in its retracted position, at least one upper coupling on an upper portion of the storage container and at least one lower coupling on a lower portion of the storage container;

the upper coupling being constructed to be (a) engaged in an interlocked relation with a lower coupling of a similar storage container stacked atop the storage container to thereby secure the storage container and the similar storage container stacked atop thereof together, and (b) disengaged from the lower coupling of the similar storage container stacked atop the storage container, thereby allowing the storage container and the similar storage container stacked atop the storage container to be separated;

the lower coupling being constructed to be (a) engaged in an interlocked relation with an upper coupling of a similar storage container stacked below the storage container to thereby secure the storage container and the similar storage container stacked below the storage container together, and (b) disengaged from the upper coupling of the similar storage container stacked below the storage container, thereby allowing the storage container and the similar storage container to be separated;

a carrying handle for enabling a user to carry the storage container; and a latch movable between (a) a latching position releasably latching the drawer in the retracted position thereof, and (b) a released position enabling the drawer to be moved to the extended position thereof.

17. A storage container according to claim 16, wherein the latch in the latching position thereof also releasably latches the upper wall in the closed position thereof, and in the released position thereof enables the upper wall to be moved to the open position thereof.

18. A storage container according to claim 17, wherein the latch is slidably mounted on a front face of the drawer for lateral movement between the latched and released positions thereof.

19. A storage container according to claim 18, wherein the upper wall on the drawer housing has a front edge with (a) a latch engaging portion having a lip protruding upwardly therefrom and (b) a recess adjacent the latch engaging portion, the recess being positioned such that, when the drawer is in the retracted position thereof and the upper wall is in the closed position thereof the latch in its released position is received in the recess, and then can be moved laterally onto the latch engaging portion and the lip thereof to affect the latched position thereof.

20. A storage container according to claim 16, wherein the drawer housing has a pair of side walls extending downwardly from the upper wall on opposing sides of the drawer.

21. A storage container according to claim 20, wherein the upper wall and the side walls of the drawer housing are fixed together so that the side walls are pivoted along with the upper wall between the open and closed positions thereof.

22. A storage container according to claim 21, wherein the drawer includes a pair of pivot pins extending from opposing sides thereof and the side walls of the drawer housing include a pair of inwardly facing tracks, the pivot pins being slidably and pivotably received in the tracks to enable (a) the upper wall and the side walls to be pivoted about the pivot pins between the open and closed positions of the upper wall, and (b) the drawer to be moved between the retracted and extended positions with the pivot pins riding within the tracks.

23. A storage container according to claim 22, wherein each side wall of the drawer housing includes a support flange extending inwardly adjacent a front end of the drawer housing and wherein the drawer has a pair of support ridges extending on each side thereof, the support ridges being supported by the support flanges to support the drawer as it moves between the retracted and extended positions thereof.

24. A storage container according to claim 23, wherein the support flanges are deflectable for clearing the support ridges as the upper wall and side walls are pivoted to the open position.

25. A storage container according to claim 20, wherein the at least one lower coupling includes a hook and the at least one upper coupling includes a receptacle, the receptacle being constructed to be (a) engaged in an interlocked relation with a hook of a similar storage container stacked atop the storage container to thereby secure the storage container and the similar storage container stacked atop thereof together, and (b) disengaged from the hook of the similar storage container stacked atop the storage container, thereby allowing the storage container and the similar storage container stacked atop the storage container to be separated;

the hook being constructed to be (a) engaged in an interlocked relation with a receptacle of a similar storage container stacked below the storage container to thereby secure the storage container and the similar storage container stacked below the storage container together, and (b) disengaged from the receptacle of the similar storage container stacked below the storage container, thereby allowing the storage container and the similar storage container to be separated.

26. A storage container according to claim 25, wherein the hook includes a plurality of hooks and the receptacle includes a corresponding plurality of receptacles.

27. A storage container according to claim 26, wherein the upper portions of the side walls each include recessed wells and wherein the receptacles are located within the recessed wells.

28. A storage container according to claim 16, wherein the carrying handle is connected to a front wall of the drawer for facilitating movement of the drawer between the retracted and extended positions thereof.

29. A storage container according to claim 16, wherein the at least one lower coupling includes a hook and the at least one upper coupling includes a receptacle, the receptacle being constructed to be (a) engaged in an interlocked relation with a hook of a similar storage container stacked atop the storage container to thereby secure the storage container and the similar storage container stacked atop thereof together, and (b) disengaged from the hook of the similar storage container stacked atop the storage container, thereby allowing the storage container and the similar storage container stacked atop the storage container to be separated;

the hook being constructed to be (a) engaged in an interlocked relation with a receptacle of a similar storage container stacked below the storage container to thereby secure the storage container and the similar storage container stacked below the storage container together, and (b) disengaged from the receptacle of the similar storage container stacked below the storage container, thereby allowing the storage container and the similar storage container to be separated.

* * * * *